United States Patent [19]

Zoor

[11] Patent Number: 4,635,955

[45] Date of Patent: Jan. 13, 1987

[54] DEVICE FOR RELEASABLY HOLDING PARTS OF SKI BINDINGS

[75] Inventor: Reinhold Zoor, München, Fed. Rep. of Germany

[73] Assignee: Heinrich Wunder GmbH & Co. KG, Dachau, Fed. Rep. of Germany

[21] Appl. No.: 699,926

[22] Filed: Feb. 8, 1985

[51] Int. Cl.[4] ..... A63C 9/084

[52] U.S. Cl. ..... 280/614

[58] Field of Search ..... 280/614, 615, 618, 632

[56] References Cited

U.S. PATENT DOCUMENTS

| | | | |
|---|---|---|---|
| 3,985,371 | 10/1976 | Pyzel | 280/614 |
| 4,261,595 | 4/1981 | Smialowski et al. | 280/614 |
| 4,444,412 | 4/1984 | Callegari | 280/614 |

FOREIGN PATENT DOCUMENTS

| | | | |
|---|---|---|---|
| 0039489 | 11/1981 | European Pat. Off. | 280/614 |
| 2621111 | 11/1977 | Fed. Rep. of Germany | 280/614 |

*Primary Examiner*—John J. Love
*Assistant Examiner*—Richard Lamb
*Attorney, Agent, or Firm*—Peter K. Kontler

[57] ABSTRACT

A device for releasably holding the boot support of a cross-country ski binding against pivotal movement relative to the ski has a retainer which is mounted on two pairs of mutually inclined links. The lower ends of the links are pivoted to the ski and the upper ends of the links are pivoted to spaced-apart portions of the retainer so as to compel the latter to move along a path which is at least substantially parallel to the upper side of the ski between an operative front end position and an inoperative rear end or retracted position. The retainer can be moved between such positions by a combination of a link which is directly pivoted to the rear part of the retainer and a lever which is fulcrumed on the ski and whose forwardly extending arm is articulately connected to the rear end of the link. The rearwardly extending arm of the lever can be pivoted by hand or by the tip of a ski pole in order to move the retainer to the operative position. The retainer is moved to inoperative position in response to pivoting of the link by the tip of a ski pole. The pin which couples the lever to the link is moved to one side of a dead-center position in response to movement of the retainer to its operative position and to the other side of such dead-center position in response to retraction of the retainer to its inoperative position.

12 Claims, 7 Drawing Figures

DEVICE FOR RELEASABLY HOLDING PARTS OF SKI BINDINGS

BACKGROUND OF THE INVENTION

The present invention relates to skis in general, and more particularly to bindings, especially for use on cross-country skis. Still more particularly, the invention relates to improvements in devices for releasably holding movable parts of ski bindings in selected positions for selected periods of time.

It is well known that the boot support of a binding is pivotable at its front end so as to enable the skier to lift the heel of one boot above and away from the upper side of the respective ski while the other ski is in the process of moving forwardly and to maintain the heel of the one boot above and away from the upper side of the respective ski at least during the initial stage of forward movement of such ski in order to catch up and to move ahead of the other ski. It is also known to releasably lock the boot supports of such cross-country ski bindings to the respective skis when the skis are used for downhill skiing.

U.S. Pat. No. 4,261,595 to Smialowski et al. discloses a device which can be used to releasably hold a mobile component of a ski binding against movement relative to the ski and, to this end, is pivotally attached to the ski. Consequently, and when the device moves from the operative position to an inoperative or retracted position, its front end travels along an arcuate path which is very close to the heel of the respective boot and even closer to that part of the binding which engages the boot. Therefore, the device is likely to collide with the means for directly engaging the boot which can present problems in that the device can jam and/or an inexperienced skier will be incapable of helping herself or himself. Moreover, pronounced pivoting of the device above and away from the upper side of the ski provides room for penetration of snow and/or ice which prevents return movement of the device to its operative position.

OBJECTS AND SUMMARY OF THE INVENTION

An object of the invention is to provide a novel and improved device which can hold one or more mobile components of a ski binding in a selected position in such a way that deactivation of the device is not likely to involve clashing with other parts of the binding.

Another object of the invention is to provide a novel and improved retainer which is especially suited for releasably holding and locking the pivotable boot support of a cross-country ski binding.

A further object of the invention is to provide a retainer which is constructed and mounted in such a way that its movements cannot be impeded by accumulations of snow or ice.

An additional object of the invention is to provide a ski binding which embodies the above outlined holding device.

A further object of the invention is to provide a novel and improved method of mounting a retainer for mobile components of ski bindings, especially cross-country bindings, at the upper sides of skis.

Still another object of the invention is to provide a device which can be mounted on skis as a superior substitute for heretofore known retaining or holding devices.

An additional object of the invention is to provide novel and improved means for guiding the retainer of the above outlined holding device.

A further object of the invention is to provide novel and improved means for moving the retainer.

An additional object of the invention is to provide novel and improved means for actuating the moving means for the retainer.

The invention is embodied in a device for releasably holding a movable component of a ski binding, particularly the pivotable boot support of a cross-country ski binding. The improved device comprises a retainer and means for mounting the retainer at the upper side of a ski. Such mounting means comprises guide means which is designed to confine the retainer to movements between an operative position, in which the retainer holds the movable component, and an inoperative position along an elongated path which is at least substantially parallel to the upper side of the ski. The arrangement is preferably such that the retainer has a first component of movement in parallelism with the upper side of the ski during movement along the aforementioned path and a second component of movement which is a fraction (preferably a small fraction) of the first component of movement. The guide means can comprise mutually inclined first and second links, means for pivotally connecting the links to the ski, and means for pivotally connecting the links to spaced-apart portions of the retainer. Alternatively, the guide means can comprise one or more coulisses which are secured to the ski and wherein the retainer is slidably mounted for movement between the operative and inoperative positions.

The device preferably further comprises means for moving the retainer between its operative and inoperative positions, and such moving means can include a link, means for pivotably attaching the link to the retainer, a lever, means for pivotably mounting the lever on the ski, and means for pivotably coupling the link to the lever. The arrangement is such that the lever is pivotable about the axis of the mounting means in clockwise and counterclockwise directions to thereby move the retainer through the medium of the link between the operative and inoperative positions. The axes of the attaching and mounting means are parallel to each other and the coupling means is preferably movable from one side to the other side of a line which connects the axes of the mounting and attaching means in response to pivoting of the lever about the axis of the mounting means between a first position corresponding to the operative position of the retainer and a second position corresponding to the inoperative position of the retainer. The coupling means is preferably disposed at a first distance from the upper side of the ski in the first position of the lever and at a lesser second distance from the upper side of the ski in the second position of the lever.

The link can be provided with first means (e.g., a recess or notch) for facilitating pivoting of the lever in one of the two directions, and the lever preferably comprises second means (e.g., a recess or notch) for facilitating its pivoting in the other direction. Such recesses or notches can receive the tip of a ski pole which is then used as a means for moving the retainer to or from the operative position by remote control. The lever can constitute a two-armed lever (e.g., a bell-crank lever) the first arm of which is coupled to the link of the moving means and the second arm of which is provided with the afore-mentioned second facilitating means. The second arm preferably abuts against or is closely adjacent to the upper side of the ski in the first position of the lever, i.e., when the retainer is held in the operative position. When the retainer is moved to its inoperative position (i.e., when the lever assumes its second position), the second arm of the lever preferably extends rearwardly from the mounting means and upwardly and away from the upper side of the ski. Means can be provided for pivoting the lever from the second to the first position, and such pivoting means can comprise an actuating element which is pivotably mounted on the ski and includes a portion (e.g., a loop-shaped section of a yoke which latter constitutes or forms part of the actuating element) which engages the second arm of the lever when the latter is held in the second position while the actuating element is caused to pivot from a raised to a lowered position.

The lever can be provided with a handle in lieu of or in addition to the second arm, or in lieu of or in addition to the actuating element, or in lieu of or in addition to the aforementioned facilitating means, so that it can be manually pivoted between its first and second positions.

The novel features which are considered as characteristic of the invention are set forth in particular in the appended claims. The improved holding device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
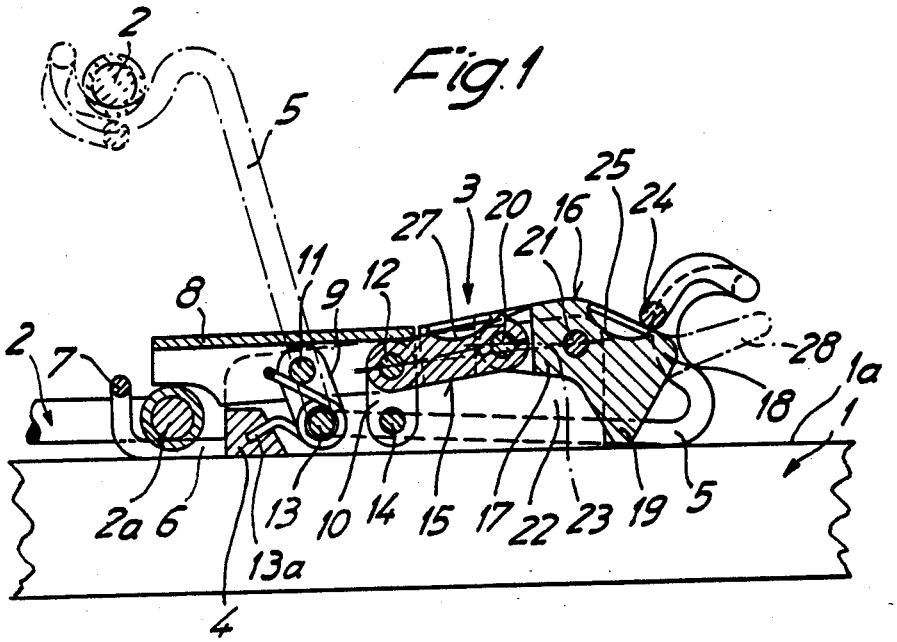
FIG. 1 is a longitudinal vertical sectional view of a holding device which embodies one form of the invention and wherein the retainer is held and locked in the operative position to releasably but reliably hold the pivotable boot support of a cross-country ski binding in a position immediately adjacent to the upper side of the ski.
Figure 2:
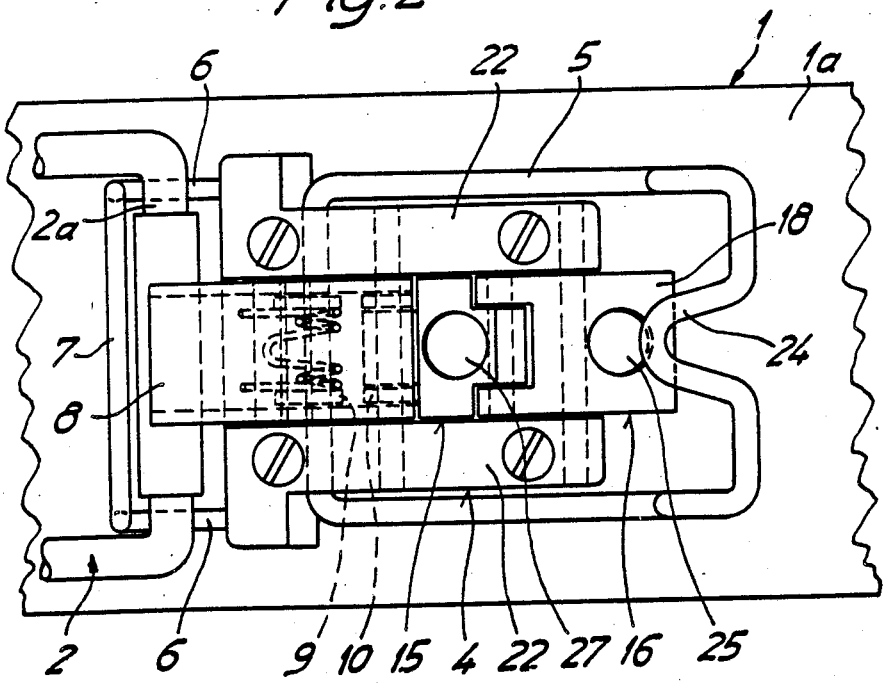
FIG. 2 is a plan view of the structure which is shown in FIG. 1.

Referring first to FIGS. 1 and 2, there is shown a portion of a cross-country ski binding which is mounted at the upper side 1*a* of a ski 1. The binding comprises a movable component constituting a boot support 2 whose front end portion (not shown) is pivotally secured to the ski in a conventional way (by means of a suitable bearing) and whose illustrated rear portion 2*a* has a substantially U-shaped outline and can be releasably held in the position which is shown in FIGS. 1 and 2 by a novel and improved retainer 8 which is mounted on the ski, which is guided for movement relative to the ski and which is movable with reference to the ski in accordance with the present invention. The boot support 2 assumes the locked position of FIGS. 1 and 2 (in which its rear portion 2*a* is adjacent to the upper side 1*a* of the ski 1) when the ski is used for downhill skiing.

The retainer 8 constitutes a mobile part of a holding device 3 having a base plate 4 which is affixed to and is adjacent the upper side 1*a* of the ski 1. The base plate 4 further supports a pivotable yoke-like actuating element 5 whose function will be described hereinafter. The base plate 4 has a forwardly extending portion 6 which can be made of steel wire or the like and whose transversely extending foremost part 7 extends upwardly and away from the upper side 1*a* of the ski 1 and is located in front of the rear portion 2*a* of the boot support 2. The part 7 of the portion 6 of the base plate 4 cooperates with the retainer 8 in holding the boot support 2 in the position of FIGS. 1 and 2 as long as the retainer 8 dwells in the operative position which is shown in FIGS. 1 and 2.

The retainer 8 is indirectly mounted on the ski 1 by a guide means including two pairs of links 9 and 10 (only one of each pair of these links can be seen in FIG. 1). The links 9 of the front pair are inclined with reference to the links 10 of the rear pair in a manner as can be readily seen in FIG. 1. The means for pivotally connecting the lower ends of the links 9 and 10 to the ski 1 (actually to the base plate 4 which can be said to form a part of the ski) includes parallel pivot members 13 and 14 which extend transversely of the ski and are located one behind the other, as considered in the longitudinal direction of the ski. The means for pivotally connecting the upper ends of the links 9 and 10 to the retainer 8 comprises two horizontal pivot members 11 and 12 which are parallel to each other and to the pivot members 13, 14. The distance between the axes of the pivot members 11, 12 (as considered in the longitudinal direction of the ski 1) exceeds the distance between the axes of the pivot members 13, 14. The just described mounting of the links 9 and 10 ensures that the retainer 8 is caused to advance along an elongated path which is at least substantially parallel to the upper side 1*a* of the ski 1 when the retainer moves between the operative position of FIGS. 1 and 2 and the inoperative or retracted position of FIGS. 3 and 4. At least during the initial stage of its movement from the operative position of FIGS. 1 and 2, the retainer 8 moves along an at least substantially horizontal path and away from the heel of the boot which rests on and is normally attached to the support 2. This greatly reduces and practically eliminates the likelihood of clashing of the front end portion of the retainer 8 with the heel or with a part of the binding which is affixed to and is located rearwardly of the heel of the boot on the support 2. As can be seen in FIG. 1, the upper side of the retainer 8 is inclined forwardly and downwardly, i.e., such upper side makes a very small acute angle with the upper side 1*a* of the ski 1. On the other hand, when the retainer 8 reaches and dwells in the inoperative or retracted position of FIG. 3, its upper side slopes in the opposite direction (namely rearwardly and downwardly) and makes a somewhat larger acute angle with the upper side 1*a* of the ski 1. Such slight deviations of the retainer 8 from horizontal position in each of its end (operative and inoperative) positions is desirable and advantageous because the retainer remains close to the upper side 1*a* and thus prevents penetration of snow and/or ice between its underside and the ski 1.

Figure 3:
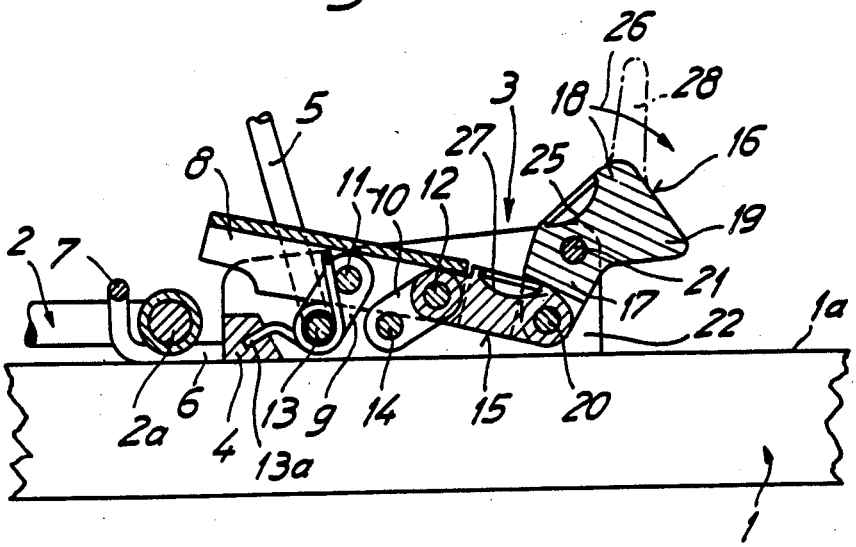
FIG. 3 illustrates the structure of FIG. 1 but with the retainer shown in the inoperative position.
Figure 4:
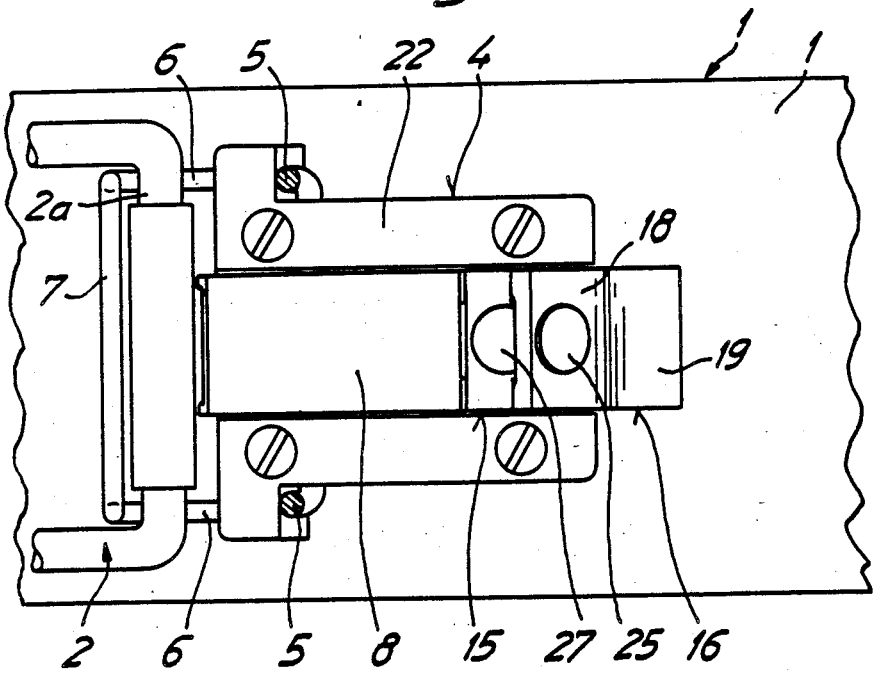
FIG. 4 is a plan view of the structure of FIG. 3.

The means for moving the retainer 8 between the operative position of FIGS. 1 and 2 and the inoperative position of FIGS. 3 and 4 comprises a link 15 and a two-armed bell crank lever 16. The front portion of the link 15 is pivotably attached to the rear portion of the retainer 8 by the aforementioned pivot member 12 which secures the retainer to the upper ends of the links 10 of the guide means. The rear end of the link 15 is pivotably coupled to the front arm 17 of the lever 16 by a pivot pin 20 which is parallel to the pivot members 11, 12, 13 and 14 as well as to a further pivot member 21 by means of which the lever 16 is mounted on the ski 1, i.e., on the base plate 4.

In FIG. 1, the axis of the pivot pin 20 is located at a level above the line 23 (indicated by dots and dashes) which connects the axis of the pivot member 12 with the axis of the pivot member 21, i.e., the neighboring portions of the link 15 and front arm 17 of the lever 16 are located above the dead-center positions of the parts 15, 16. This ensures that the retainer 8 is reliably held in the operative position of FIGS. 1 and 2 until and unless the user of the ski 1 decides to move the retainer 8 to the inoperative position of FIGS. 3 and 4. Such movement of the retainer 8 to the inoperative position is assisted by a torsion spring 13*a* which is coiled around the pivot member 13, one end portion of which is anchored in the base plate 4 and the other end portion of which bears against the pivot member 11 in the space between the two links 9.

The base plate 4 comprises two detachable longitudinally extending parallel sidewalls or cheeks 22 which constitute bearings for the respective end portions of the pivot member 21, i.e., for the means which defines a fulcrum for the lever 16.

The second or rear arm of the lever 16 comprises two portions or sections 18 and 19. The section 19 abuts against the upper side 1*a* of the ski 1 or against the upper side of the base plate 4 when the retainer 8 is held in the operative position of FIGS. 1 and 2, and such section 19 extends rearwardly and upwardly and is remote from the upper side of the ski when the retainer 8 is caused to move to the inoperative position of FIG. 3. Thus, the section 19 of the second arm of the lever 16 limits the extent to which the lever can be pivoted in a clockwise direction, as viewed in FIG. 3, and the extent to which the axis of the pivot pin 20 can move above the dead-center position, i.e., above the line 23. As mentioned above, such positioning of the axis of the pivot pin 20 ensures that the retainer 8 is reliably held in the operative position until and unless the lever 16 is subjected to the action of a force which suffices to pivot it in a counterclockwise direction, as viewed in FIG. 1, so as to move the axis of the pin 20 first into the plane of the line 23 (i.e., into a plane which is normal to the plane of FIG. 1) and thereupon to the position of FIG. 3 in which the axis of the pin 20 is located well below the line 23 (not shown in FIG. 3). It will be noted that the pivot pin 20 is rather close to the upper side 1*a* of the ski 1 in the inoperative position of the retainer 8 and is more distant from the upper side of the ski when the retainer is caused to assume the operative position.

When the retainer 8 is held in the inoperative position of FIG. 3 and the section 19 of the rear arm of the lever 16 extends rearwardly and upwardly, the other section 18 of the rear arm of the lever 16 is located in the path of downward movement of the suitably looped rear end portion 24 of the substantially yoke-like actuating element 5. Thus, when the element 5 is pivoted from the raised position which is indicated in FIG. 1 by phantom lines to the position which is shown in FIG. 1 by solid lines and in which the element 5 abuts against the upper side 1*a* of the ski 1 adjacent to the outer sides of the sidewalls 22, the rear end portion 24 pivots the lever 16 clockwise from the position of FIG. 3 to the position of FIG. 1 to thereby automatically return the retainer 8 to the operative position. The just mentioned pivoting of the lever 16 entails an upward movement of the pivot pin 20 further away from the ski 1 toward and beyond the dead-center position so that the retainer 8 is again reliably held in the operative position of FIG. 1.

Figure 5:
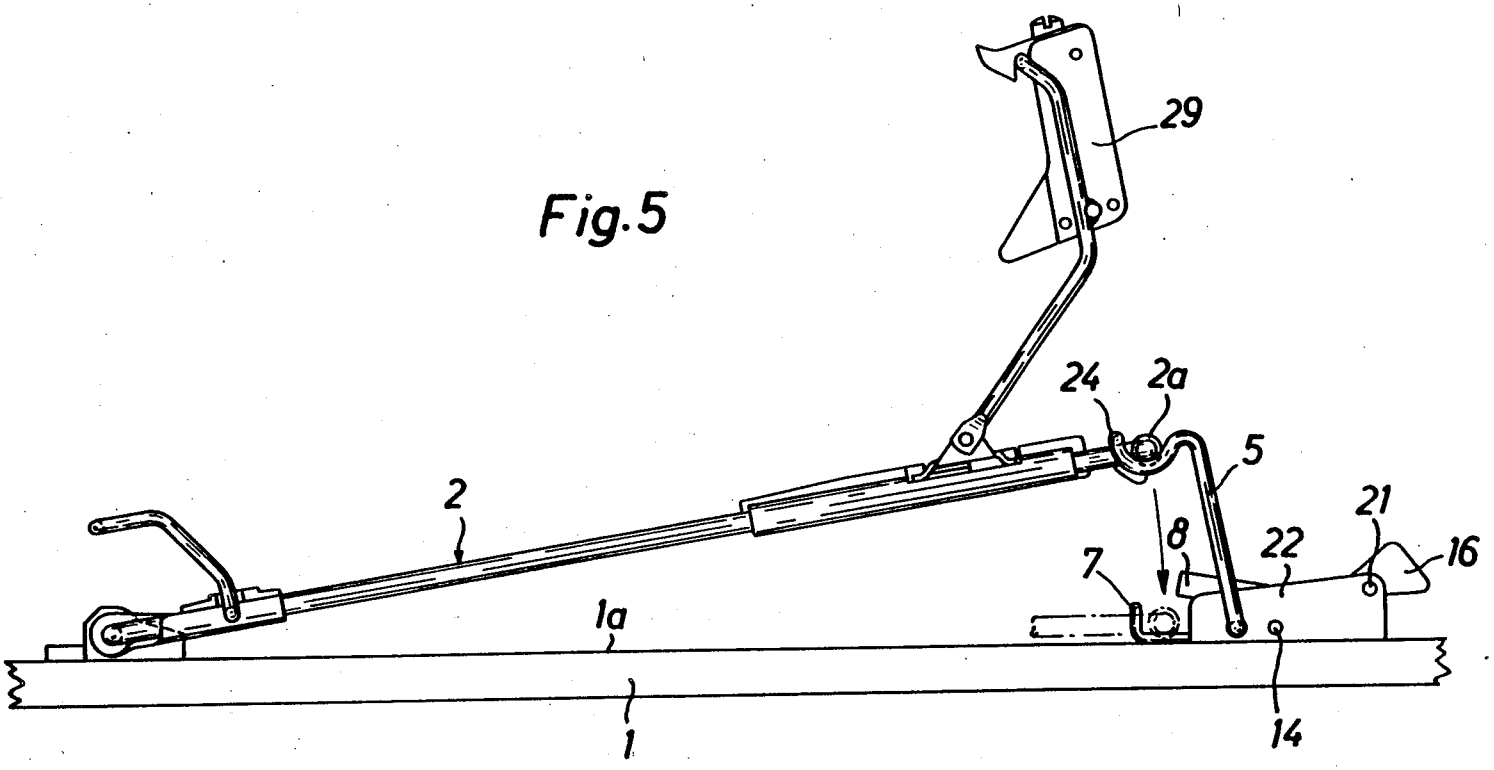
FIG. 5 is a side elevational view of the holding device and of a boot support, the boot support being shown in raised position.

The actuating element 5 can further serve as a means for maintaining the rear portion 2*a* of the boot support 2 in an inclined position as shown in the upper left-hand portion of FIG. 1 and in FIG. 5. The configuration of the looped rear end portion 24 of the element 5 is such that this looped portion can receive the transversely extending rear portion 2*a* of the support 2 when the latter is pivoted above and away from the upper side 1*a* of the ski 1.

The actuating element 5 constitutes but one of several means for pivoting the lever 16 about the axis of the pivot member 21. Pivoting of the lever 16 in a clockwise direction, as viewed in FIG. 3 (in order to move the retainer 8 from the inoperative position of FIG. 3 to the operative position of FIG. 1) can also be effected by the tip of a ski pole (not shown) which can be inserted into a recess or notch 25 provided in the upper side of the second arm of the lever 16 for the purpose of facilitating clockwise pivoting of this lever so that its section 19 comes into abutment with the ski 1 or with the base plate 4. The direction in which the lever 16 can be pivoted by the tip of a ski pole which is inserted into the recess 25 is indicated by the arrow 26 shown in FIG. 3.

The means for facilitating pivoting of the lever 16 in the opposite direction comprises a recess or notch 27 which is provided in the upper side of the link 15 and can receive the tip of a ski pole to effect a depression of the pivot pin 20 from the position of FIG. 1 to the position of FIG. 3, i.e., from a position at a greater distance to a position at a lesser distance from the ski 1.

FIGS. 1 and 3 further show that the parts 8, 15 and 16 constitute a chain of articulately connected parts which do not have any pronounced upwardly or downwardly protruding portions to thus greatly reduce the likelihood of penetration of snow or ice between such parts or between the chain and the upper side 1*a* of the ski 1. This also greatly reduces the likelihood that snow or ice could interfere with movements of the retainer 8 between the operative and inoperative positions. The parts 8, 15 and 16 of the aforementioned chain do not overlap each other and do not define any pronounced upwardly open channels or pockets which also reduces the likelihood of penetration of snow or ice into those regions where such material could interfere with proper operation of the improved holding device 3.

When the retainer 8 is held in the inoperative position of FIG. 3, its front end is located sufficiently above the rear portion 2*a* of the boot support 2 and sufficiently rearwardly of the portion 2*a* to greatly reduce and practically eliminate the possibility of collision with the heel of a ski boot on the support 2 and/or with that part 29 (see FIG. 5) or those parts of the binding which might be attached to and extend rearwardly of the heel.

The reference character 28 denotes a handle which is shown in FIGS. 1 and 3 by phantom lines because it constitutes an optional feature of the holding device 3 and which can also serve as a means for pivoting the lever 16 in or counter to the direction which is indicated by the arrow 26. The handle 28 extends upwardly from the upper section 18 of the rear arm of the lever 16. This handle will be used as a means for pivoting the lever 16 when a ski pole is not available or the nature of the implement which is available to the skier is such that it cannot be adequately inserted into the recess 25 and/or 27. Pivoting of the handle 28 in a counterclockwise direction, as viewed in FIG. 1, brings about the same result as the depression of the rear portion of the link 15 by the tip of a ski pole which is inserted into the recess 27, i.e., the retainer 8 is moved from the operative to the inoperative position. Pivoting of the handle 28 in a clockwise direction, as viewed in FIG. 3, is tantamount to pivoting of the lever 16 by the rear end portion 24 of the actuating element 5 or by the tip of a ski pole which is inserted into the recess 25.

The configuration of the rear end portion 24 of the actuating element 5 can be changed if the lever 16 is provided with the handle 28, i.e., the rear end portion 24 is then not required to pivot the lever 16 clockwise while the actuating element 5 is pivoted from the phantom-line position to the solid-line position of FIG. 1. Such modified configuration of the rear end portion 24 of the actuating element 5 is indicated in the upper left-hand portion of FIG. 1 by phantom lines.

If the guide means including the pairs of links 9 and 10 is replaced by coulisses 30 (FIGS. 6 and 7) which define a path for sliding movement of the retainer 8 between the operative and inoperative positions, such path can be exactly or at least substantially exactly parallel to the upper side of the ski. This even further reduces the likelihood of a collision between the front end portion of the retainer and the heel of a ski boot or that part or those parts of the binding which are attached to and extend rearwardly of the heel, i.e., nearer toward the retainer.

Figure 6:
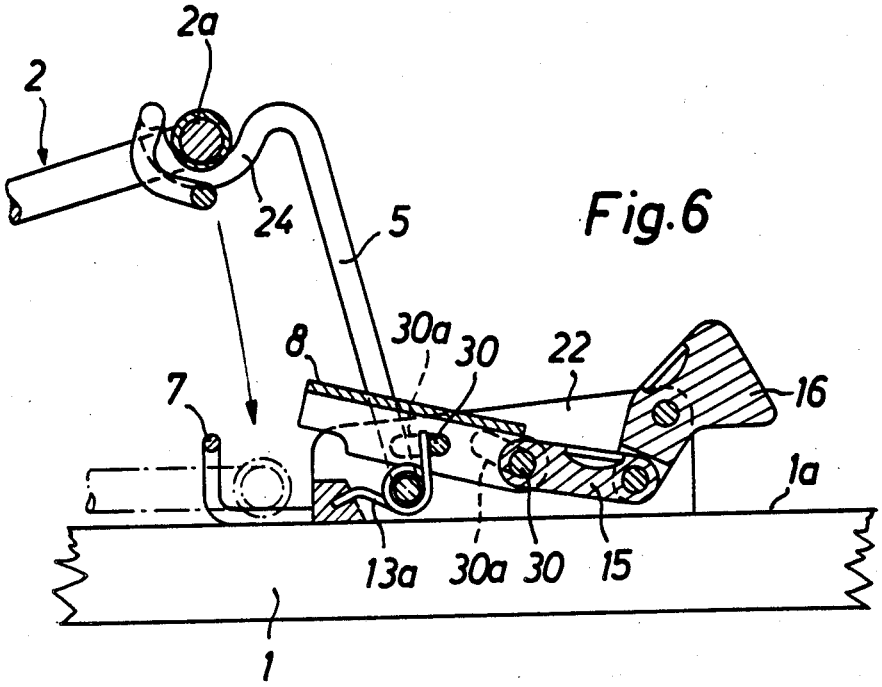
FIG. 6. is a view similar to that of FIG. 1 but showing a modified holding device in the inoperative position.
Figure 7:
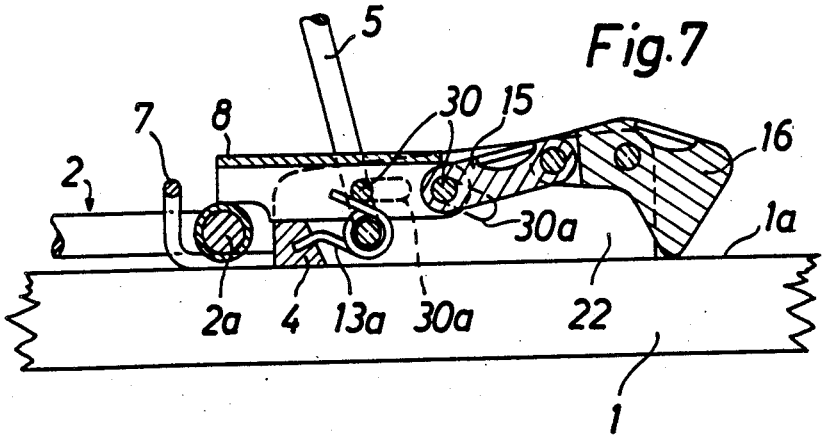
FIG. 7 shows the holding device of FIG. 6 in the operative position.

The guide means including the links 9, 10 and the pivot members 11 to 14 or the structure of FIGS. 6 and 7 exhibits the aforediscussed advantage that the retainer 8 is confined to movement along a path which is at least substantially parallel to the upper side 1*a* of the ski 1. Moreover, such guide means insures that the retainer 8 can be moved forwardly and backwards with a minimum of friction. Still further, the guide means 9–14 as well as the guide means of FIGS. 6 and 7 is extremely simple, rugged and inexpensive. Slight pivoting of the retainer 8 during its movement to the operative and inoperative positions is of advantage, at least in some types of ski bindings, because such pivoting even further reduces the likelihood of clashing with the heel and/or with the parts which are attached to and extend rearwardly from the heel forming part of the boot on the support 2. Thus, the dimensioning and mounting of the links 9, 10 relative to each other and with reference to the ski 1 and retainer 8 or of the slots 30*a* shown in FIGS. 6 and 7 can be such that the retainer performs a pivotal movement during the initial stage of its movement from the position of FIG. 1. The major component of such movement is preferably a component which is parallel to the upper side of the ski 1 to rapidly move the front part of the retainer 8 rearwardly and away from the heel. Still further, some slight pivoting of the retainer 8 during movement toward the position of FIG. 1 or FIG. 3 or during movement toward the position of FIG. 6 or 7 can entail the expulsion of snow which might have penetrated between the underside of the retainer and the upper side 1*a* of the ski. The snow is much more likely to be expelled if the retainer 8 performs a combined pivotal and translatory movement because this entails some shifting or pushing of the snow in contrast to a purely pivotal movement of the retainer which would bring about a compacting action without any shifting or sweeping action. However, and as mentioned above, the likelihood of penetration of snow between the retainer and the ski is remote, especially if the retainer performs a purely translatory movement or a movement having its major component extending in parallelism with the upper side of the ski because this renders it possible to place the retainer close or very close to the ski.

The illustrated moving means including the link 15 and the lever 16 also exhibits a number of important advantages. Thus, the link 15 can be used as a means for effecting a movement of the retainer 8 from the operative position of FIG. 1 to the inoperative position of FIG. 3 by the simple expedient of exerting pressure in the region of the recess 27 so as to move the pivot pin 20 downwardly toward the upper side 1*a* of the ski 1, i.e., to and beyond the dead center position in which the axis of the pin 20 intersects the line 23. Of course, the handle 28 can also serve as a means for moving the retainer 8 to the inoperative position of FIG. 3; the handle 28 is then pivoted in the direction of arrow 26 which is shown in FIG. 3.

The illustrated shape of the lever 16 exhibits the advantage that the section 18 of the rear arm of this lever is automatically placed into the path of downward movement of the rear end portion 24 of the actuating element 5 when the retainer 8 is caused to assume its operative position. This ensures that the retainer 8 automatically reassumes its operative position in response to pivoting of the actuating element 5 to the position of FIG. 2 i.e., to the position which is shown in FIG. 1 by solid lines. Furthermore, the illustrated shape of the lever 16 ensures that the orientation of the recess 25 is best suited for reception of the tip of a ski pole when the retainer 8 is held in the inoperative position of FIG. 3 so that the user of the ski need not bend in order to engage and pivot the handle 28 but can pivot the lever 16 clockwise by remote control with the result that the retainer 8 is returned to the operative position of FIG. 1.

In certain presently known holding devices, the means for moving the retainer also comprises a lever but the part which could be said to correspond to the link 15 of the improved moving means is a second two-armed lever one arm of which overlaps the other lever and serves as a means for pivoting the two levers in a direction to pivot the retainer away from its operative position. This provides room for penetration of snow between such arm of the second lever and the other lever and is likely to interfere with predictable pivoting of the levers. The provision of a moving means wherein the part which is directly connected to the retainer is a link rather than a multi-armed lever greatly reduces the likelihood of clogging the moving means by snow and of excessive resistance to movement of the retainer to the one or the other position. The placing of the recess 25 close or very close to the pivot pin 20 is desirable or advantageous because this further reduces the effort which must be exerted in order to move the retainer 8 to the inoperative position of FIG. 3.

The actuating elements 5 can be used as an aid to the skier when the cross-country skis are used for climbing a hill by holding the rear portions 2*a* of the supports 2 in raised positions as shown in FIG. 5. The length of and the bearings for the actuating elements 5 will be selected with a view to ensure that each support 2 is held at an optimum angle with reference to the upper side 1*a* of the corresponding ski 1. This is of considerable help when the skis are used for cross-country skiing on uneven terrain and while the cross-country skier is in the process of climbing a hill. When the climbing is completed and the binding is to be converted into one which is best suited for downhill skiing, the supports 2 are disengaged from the end portions 24 of the corresponding actuating elements 5 and the latter are pivoted out of the way, i.e., to the positions corresponding to the solid-line position of the element 5 shown in FIGS. 1 and 2, whereby the end portions 24 automatically pivot the levers 16 in the direction of arrow 26 to automatically lock the supports 2 in the positions corresponding to that shown in FIGS. 1 and 2.

The aforediscussed feature that the section 19 of the lever 16 abuts against the ski 1 or against the base plate 4 when the retainer 8 is held in the operative position of FIG. 1 is desirable and advantageous because this obviates the need for separate or additional means which would hold the pivot pin 20 at one side of the dead center position to thereby prevent unintentional or accidental movement of the retainer from its operative position.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A device for releasably holding a movable component of a ski binding, particularly for releasably holding the pivotable boot support of a cross-country ski binding, comprising a retainer; and means for movably mounting said retainer at the upper side of the ski, including guide means for confining said retainer to movements between an operative position, in which the retainer holds the movable component, and an inoperative position along a composite non-circular path a portion at least of which is at least substantially parallel to the upper side of the ski, said guide means comprising mutually inclined first and second links, means for connecting said links to the ski for pivotal movement about fixed axes, and means for pivotally connecting said links to spaced-apart portions of said retainer.

2. The device of claim 1, wherein said retainer has a first component of movement in parallelism with, and a second component of movement at right angles to the upper side of the ski during movement along said path, the second component being smaller than the first component.

3. The device of claim 1, further comprising means for moving said retainer between said positions, including a further link, means for pivotably attaching said further link to said retainer, a lever, means for pivotably mounting said lever on the ski, and means for pivotably coupling said lever to said further link, said lever being pivotable in clockwise and counterclockwise directions about the axis of said mounting means to thereby move said retainer by way of said further link.

4. The device of claim 3, wherein said attaching and said mounting means have parallel axes and said coupling means is movable from one side to the other side of a line connecting said axes in response to pivoting of said lever about the axis of said mounting means between a first position corresponding to the operative position and a second position corresponding to the inoperative position of said retainer.

5. The device of claim 4, wherein said coupling means is disposed at a first distance from the upper side of the ski in the first position and at a lesser second distance from the upper side of the ski in the second position of said lever.

6. The device of claim 4, wherein said further link comprises first means for facilitating pivoting of said lever in one of said directions and said lever comprises second means for facilitating its pivoting in the other of said directions.

7. The device of claim 6, wherein first and second facilitating means comprise first and second recesses respectively provided in said further link and said lever and each arranged to receive the tip of a ski pole.

8. The device of claim 7, wherein said lever comprises a first arm which is coupled to said link and a second arm which is provided with said second recess.

9. The device of claim 4, wherein said lever comprises a first arm which is coupled to said further link and a second arm which abuts against or is closely adjacent to the upper side of the ski in the first position of said lever, said second arm being arranged to extend rearwardly from said mounting means and upwardly and away from the upper side of the ski in the second position of said lever.

10. The device of claim 9, further comprising means for pivoting said lever from said second to said first position, including an actuating element pivotably mounted on the ski.

11. The device of claim 10, wherein said element is pivotable between a raised position in which a portion thereof is remote from the upper side of the ski and a lowered position in which said portion thereof is adjacent to the upper side of the ski, said second arm being located in the path of movement of said portion of said element while the latter pivots from said raised to said lowered position.

12. The device of claim 4, wherein said lever comprises a handle which facilitates the movements of said lever between said first and second positions.

* * * * *